US010232920B2

(12) United States Patent
Naughton

(10) Patent No.: US 10,232,920 B2
(45) Date of Patent: Mar. 19, 2019

(54) RECOVERY DEVICE

(71) Applicant: Chad Naughton, Coldwater (CA)

(72) Inventor: Chad Naughton, Coldwater (CA)

( * ) Notice: Subject to any disclaimer, the term of this patent is extended or adjusted under 35 U.S.C. 154(b) by 290 days.

(21) Appl. No.: 14/727,888

(22) Filed: Jun. 2, 2015

(65) Prior Publication Data

US 2016/0355244 A1 Dec. 8, 2016

(51) Int. Cl.

| | |
|---|---|
| ***B63B 22/16*** | (2006.01) |
| ***B63B 22/22*** | (2006.01) |
| ***B63C 7/26*** | (2006.01) |
| *B60C 29/00* | (2006.01) |

(52) U.S. Cl.
CPC . *B63C 7/26* (2013.01); *B63C 9/24* (2013.01)

(58) Field of Classification Search
CPC .... B63C 7/00; B63C 7/16; B63C 7/26; B63C 2007/00; B63B 22/00; B63B 22/22; B63B 22/24; B63B 2022/00
USPC ..... 441/6, 7–10, 30–33
See application file for complete search history.

(56) References Cited

U.S. PATENT DOCUMENTS 2,642,693 A * 6/1953 Broady ..... A01K 87/00 114/54
2,752,615 A * 7/1956 Parker ..... B63C 7/26 102/407
2,830,309 A * 4/1958 Lawson ..... B63B 22/22 116/210
3,366,983 A * 2/1968 Adams ..... B63B 22/10 441/8
3,449,747 A * 6/1969 Hennessey ..... B63C 7/26 342/8
3,710,409 A * 1/1973 Davidson ..... B63C 9/23 441/23
5,657,917 A * 8/1997 Johnson ..... A45F 3/04 224/153
6,080,027 A 6/2000 Rodemann
6,347,970 B1 * 2/2002 Weinel ..... B63C 7/10 114/68
7,017,195 B2 3/2006 Buckman et al.
7,083,487 B2 * 8/2006 Weinel ..... B63C 9/082 441/131
7,270,077 B2 9/2007 Beck
9,162,738 B1 * 10/2015 Faletra ..... B63B 7/08
2008/0257643 A1 10/2008 Weinel et al.
(Continued)

FOREIGN PATENT DOCUMENTS

CA 2046383 10/1992
CA 2223312 A1 12/1997
CA 2336491 A1 8/2001
(Continued)

*Primary Examiner* — Daniel V Venne
(74) *Attorney, Agent, or Firm* — Black, McCuskey, Souers & Arbaugh, LPA

(57) ABSTRACT

A recovery device can include a bladder, a canister, an opening mechanism, and a tether. The bladder can be disposable in an inflated configuration and an un-inflated configuration. The canister can contain a compressed fluid and be coupled with the bladder. The opening mechanism can be configured to selectively open the canister and direct the compressed fluid into the bladder. The tether can extend between a first end coupled to the bladder and a second end engageable with a vehicle. The bladder in the inflated configuration can define a volume of less than one-tenth of a cubic meter.

13 Claims, 4 Drawing Sheets

(56) References Cited

U.S. PATENT DOCUMENTS

2014/0273678 A1* 9/2014 Meyer ..... B63B 22/22
441/31

FOREIGN PATENT DOCUMENTS

| | | | |
|---|---|---|---|
| CA | 2495758 | A1 | 2/2004 |
| CA | 2750288 | A1 | 7/2010 |
| CA | 2811303 | A1 | 3/2012 |

* cited by examiner

RECOVERY DEVICE

BACKGROUND

1. Field

The present disclosure relates to relates generally to a recovery device usable with personal recreational vehicles.

2. Description of Related Prior Art

U.S. Pat. No. 7,083,487 discloses an emergency flotation and recovery device. The emergency rescue and recovery device includes a portable bundle with an inflatable bladder in a storage position. In one example, the inflatable bladder has a substantially toroid geometry when inflated. The portable bundle further includes a gas canister in communication with the inflatable bladder, and an opening mechanism coupled to the gas canister. A tether is coupled to the inflatable bladder. A manual trigger is coupled to the opening mechanism, and is operable to initiate inflation of the bladder. Optionally, the portable bundle includes a pouch and at least the inflatable bladder, the gas canister, and the opening mechanism are disposed within the pouch. A method for using an emergency rescue and recovery device includes coupling the portable bundle to a vehicle or person. A manual trigger is operated to inflate the bladder. The method includes inflating the bladder into a substantially toroid geometry splitting the enclosure.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A recovery device can include a bladder, a canister, an opening mechanism, and a tether. The bladder can be disposable in an inflated configuration and an un-inflated configuration. The canister can contain a compressed fluid and be coupled with the bladder. The opening mechanism can be configured to selectively open the canister and direct the compressed fluid into the bladder. The tether can extend between a first end coupled to the bladder and a second end engageable with a vehicle. The bladder in the inflated configuration can define a volume of less than one-tenth of a cubic meter.

BRIEF DESCRIPTION OF THE DRAWINGS

The detailed description set forth below references the following drawings.

DETAILED DESCRIPTION

The present disclosure, as demonstrated by the exemplary embodiment described below, can provide a device that can allow the owner/operator of a snowmobile or all-terrain vehicle that has become submerged in water after breaking through ice. The recovery device can allow the location of the submerged vehicle to be easily identified by including an inflatable bladder that float to the surface of the water. The recovery device can also allow the vehicle to be recovered by having a tether that can be used to pull the vehicle from its resting place; the bladder is not sized to suspend the vehicle or the rider. The recovery device can also assist the rider in escaping the water by including one or more ice picks mounted on the bladder.

Figure 1:
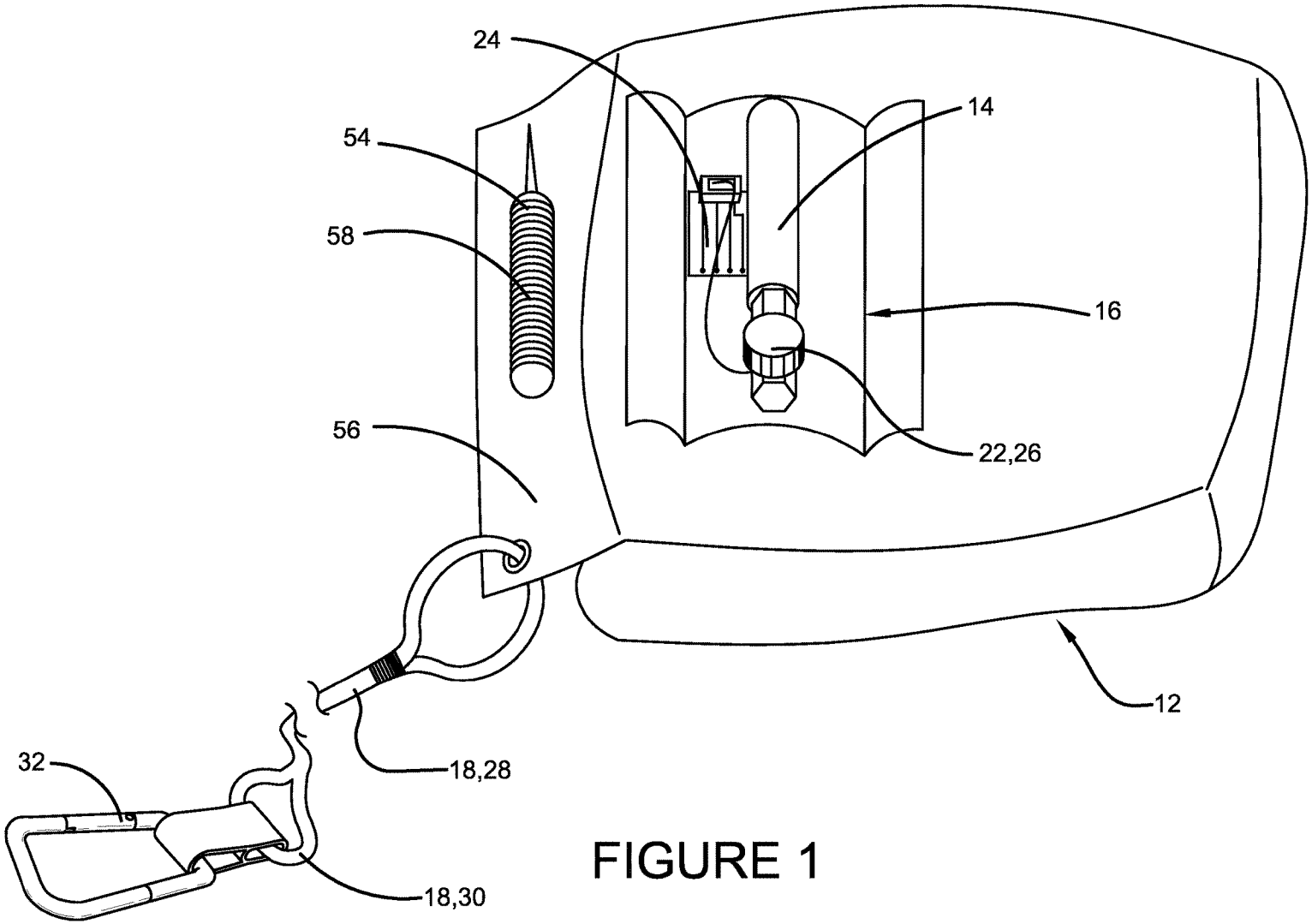
FIG. 1 is a perspective view of a bladder according to an exemplary embodiment of the present disclosure.
Figure 2:
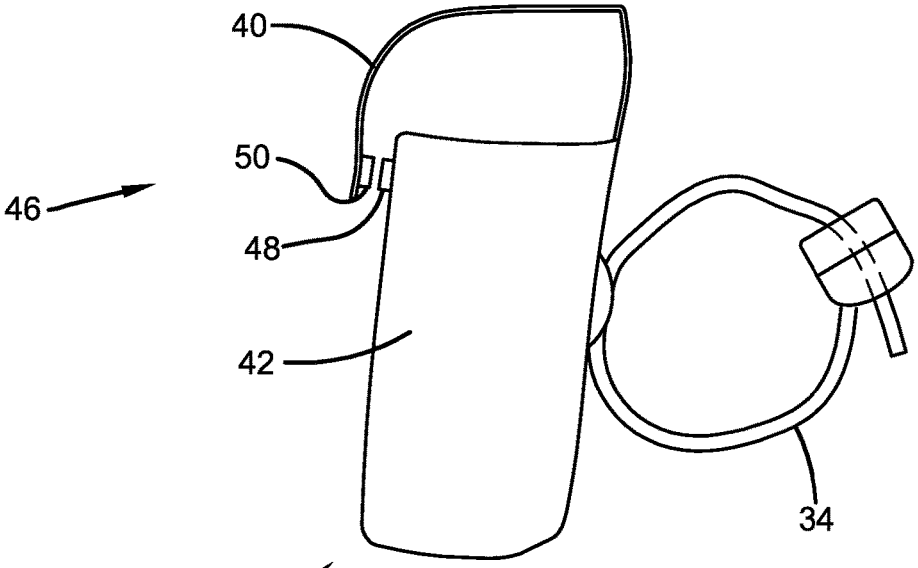
FIG. 2 is a side view of a pouch according to an exemplary embodiment of the present disclosure.
Figure 3:
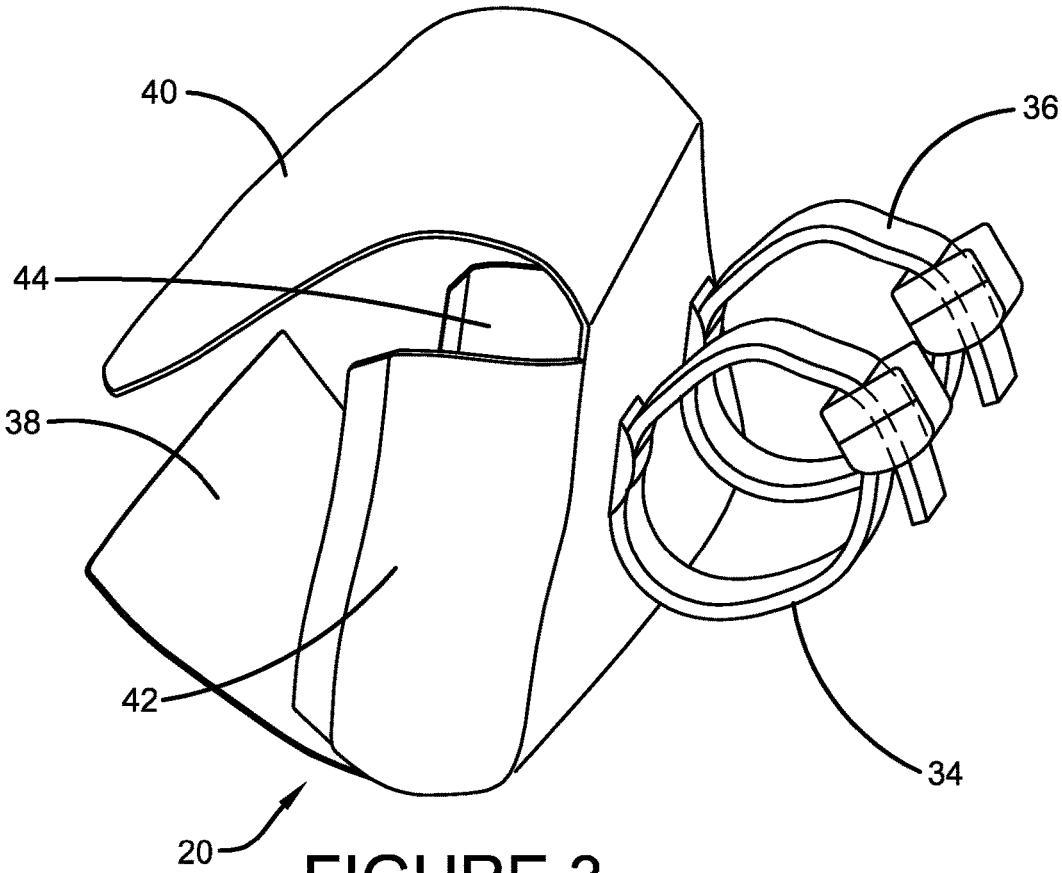
FIG. 3 is a perspective view of the pouch shown in FIG. 2.

An exemplary recovery device 10 can include a bladder 12, a canister 14, an opening mechanism 16, a tether 18, and a pouch 20. Referring now to FIG. 1, the bladder 12 can be disposable in an inflated configuration and an un-inflated configuration. The bladder 12 can be formed from any material that is desired and that conforms to operational expectations. By way of example and not limitation, the bladder 12 can be formed from a polymer suitable for use in water such as polyethylene, polypropylene, polyester, polyurethane, polyvinyl chloride, or the like. The bladder 12 can be formed from a material that is reinforced with fibers.

The canister 14 can contain a compressed fluid and be coupled with the bladder 12. The bladder 12 can envelop the canister 14 when the bladder 12 is in the un-inflated configuration. For example, the bladder, while un-inflated, can be wrapped around the canister 14.

The opening mechanism 16 can be operably coupled to the canister 14 and the bladder 12 such that the opening mechanism 16 is configured to selectively open the canister 14 and direct the compressed fluid into the bladder 12 thereby converting the bladder 12 from the un-inflated configuration to the inflated configuration. U.S. Pat. No. 7,017,195 is hereby incorporated by reference for an automatically opening inflation device. The sensors in the '195 patent can be replaced with a sensor capable of detecting the presence of water. A Grove Sensor SEN11304P is such a sensor.

Figure 4:
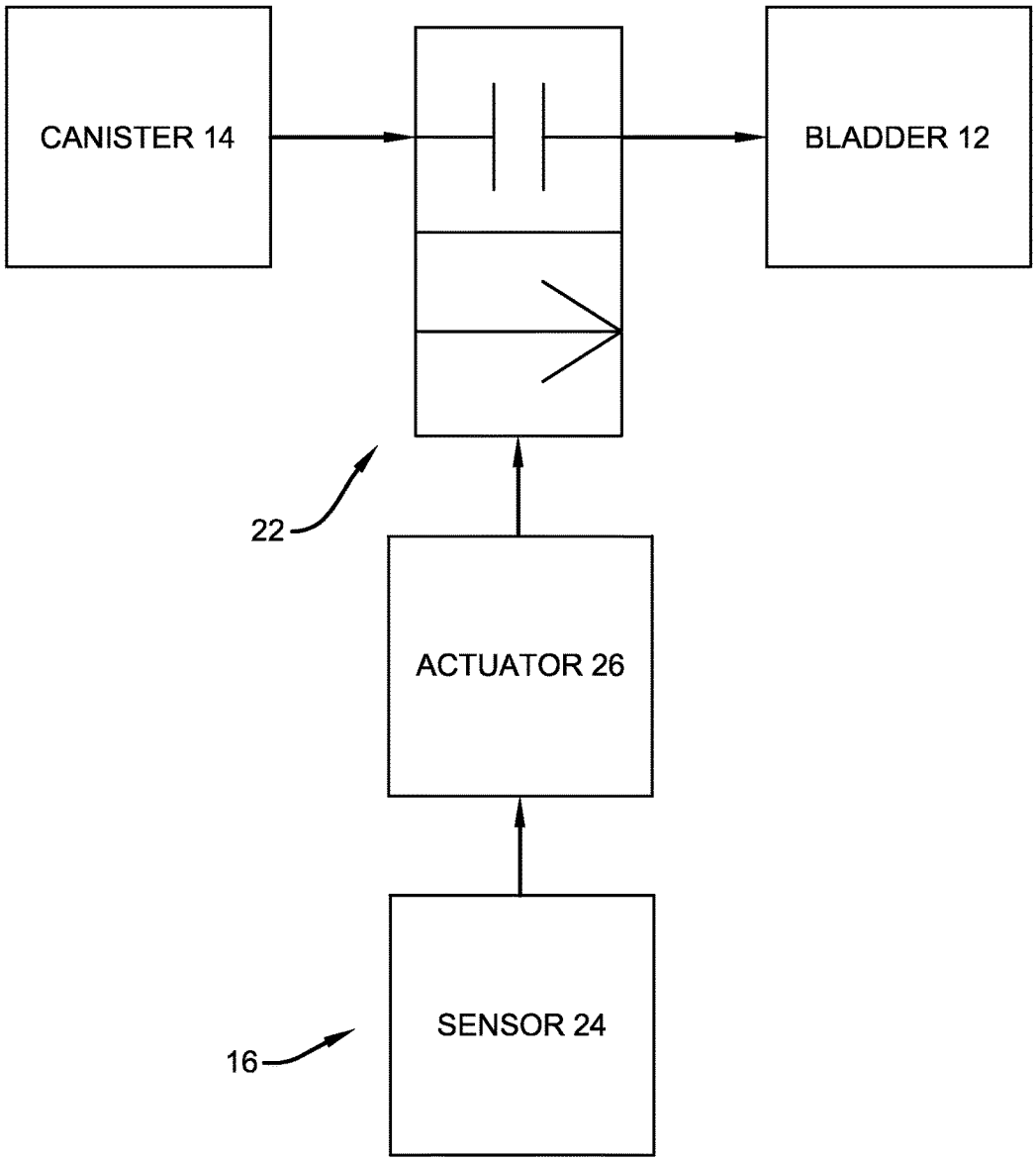
FIG. 4 is a schematic view of a bladder, canister, and opening mechanism according to an exemplary embodiment of the present disclosure.
Figure 5:
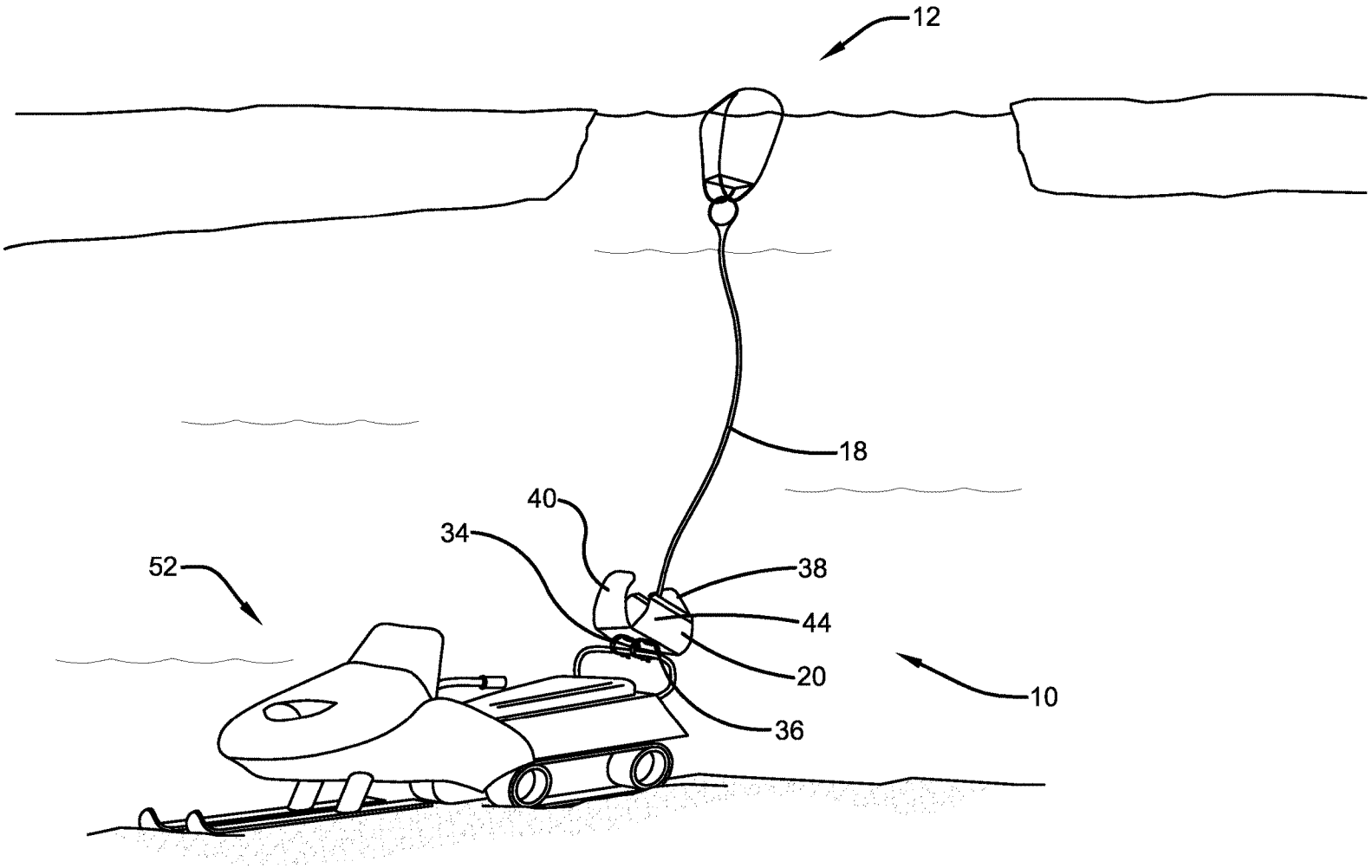
FIG. 5 is a perspective view of an embodiment of the present disclosure in an exemplary operating environment.

FIG. 4 is a schematic illustration of an exemplary embodiment of the present disclosure. The opening mechanism 16 is operably disposed between the canister 14 and the bladder 12. The exemplary opening mechanism 16 includes a valve 22 adjustable between an open configuration and a closed configuration. The exemplary opening mechanism 16 also includes a sensor 24 configured to detect moisture and emit a signal in response to detection of moisture. The exemplary opening mechanism 16 also includes an actuator 26 operable to receive the signal from the sensor 24 and adjust the valve 22 to the open configuration.

The tether 18 can extend between a first end 28 coupled to the bladder 12 and a second end 30. A carabiner 32 can interconnect the second end 30 of the tether 18 directly to a vehicle. Alternatively, the second end 30 can be connected indirectly to the vehicle through the pouch 20. In either embodiment, the second end 30 is engageable with the vehicle. The tether 18 can be configured to support a weight of at least three hundred pounds. Thus, the tether 18 can be strong enough to be used to pull a submerged snowmobile or all-terrain vehicle out of the water. The tether 18 can extend at least ten feet in one or more embodiments of the present disclosure. The tether 18 can extend between twenty and fifty feet in one or more embodiments of the present disclosure.

One or more straps, such as straps 34, 36, can be coupled to the pouch 20 and configured to couple the pouch 20 to a vehicle. The straps 34, 36 can be closed to define respective loops with buckles, hook and loop fasteners, clips, or any other kind of connecting structure.

The pouch 20 can have an interior configured to contain the bladder 12 when the bladder 12 is in the un-inflated configuration. The tether 18 can be coiled or wound and stowed in the pouch 20 as well. The second end of the tether 18 can be coupled to the pouch 20. The pouch 20 can be constructed from a pliable material such as, by way of example and not limitation, nylon or canvas. The pouch 20 can be constructed to permit water to pass into the interior so that water will contact the sensor 24 if the vehicle is submerged.

The exemplary pouch 20 can include four flaps 38, 40, 42, 44 that at least partially fold-over one another to enclose the interior. A magnetic clasp 46 can retain the flaps 38, 40, 42, 44 in the closed position. The magnetic clasp 46 can be disposed on two of the four flaps 38, 40, 42, 44. A first portion 48 of the clasp 46 can be on the flap 38 and a second portion 50 of the clasp 46 can be on the flap 40.

In operation, the un-inflated bladder 12 can be rolled about the canister 14 and opening mechanism 16 and placed in the interior of the pouch 20. The flaps 38, 40, 42, 44 can then be folded over one another and fixed together with the clasp 46. The pouch 20 can then be connected to a vehicle 52 with straps 34, 36.

If the vehicle 52 becomes submerged, water will cause the sensor 24 to emit a signal and, in response to the signal, the actuator 26 can cause the valve 22 to open. The contents of the canister 14 will then pass to the bladder 12 and thereby inflate the bladder 12. The interior of the pouch 20 can be sized smaller than the bladder 12 when the bladder 12 is in the inflated configuration. Thus, when the bladder 12 inflates, the bladder 12 can cause the pouch 20 to burst wherein the clasp 46 is overcome and the flaps 38, 40, 42, 44 release from one another. The bladder 12 can then float to the surface while unwinding the tether 18. The vehicle 52 can then be drawn out of the water with the tether 18. As set forth above, the second end 30 of the tether 18 can be connected directly to the vehicle 52 (such as with a carabiner 32) or indirectly through the pouch 20. The present disclosure is broader than any one approach of interconnecting the tether 18 to the vehicle 52.

The bladder 12 in the inflated configuration can define a volume of less than one-tenth of a cubic meter. Generally, snowmobiles can weigh between three hundred and seven hundred pounds. The force of buoyancy is equal to the density of the fluid being displaced multiplied by the acceleration of gravity further multiplied by the volume of the fluid displaced. As set forth above, the recovery device 10 is not configured to suspend the vehicle 52. Thus, the bladder 12 can be configured to generate a buoyancy force of less than eight hundred and ninety Newtons (two hundred pounds). Where the density of water is 999.97 $kg/m^3$ and the acceleration due to gravity is 9.78 $m/s^2$, the volume of the bladder 12 when inflated can be 0.09 $m^3$.

The bladder 12 can be sized in view of the function of rising to the surface while drawing the tether 18 and one or more ice picks (as further described below). Therefore, in various embodiments of the present disclosure, the bladder 12 can be configured to generate a buoyancy force of less than seven hundred Newtons, or less than six hundred Newtons, or less than five hundred Newtons, or less than four hundred Newtons, or less than three hundred Newtons, or less than two hundred Newtons, or less than one hundred Newtons.

In one or more exemplary embodiments of the present disclosure, the recovery device 10 can include at least one ice pick 54 mounted on the bladder 12. One more ice picks 54 can be connected to a flap 56 of the bladder 12 through an elastic band 58. A removable cap can be placed over the working end of the ice pick 54 to prevent the ice pick 54 from puncturing the bladder 12. The ice pick 54 can be desirable to help the rider escape the water if the vehicle 52 becomes submerged.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or sub-combinations that are disclosed herein as other present disclosures in other patent documents is hereby unconditionally reserved.

What is claimed is:

1. A recovery device comprising:

a bladder disposable in an inflated configuration and an un-inflated configuration;

a canister containing a compressed fluid and coupled with said bladder;

an opening mechanism operably coupled to said canister and said bladder such that said opening mechanism is configured to selectively open said canister and direct the compressed fluid into said bladder thereby converting said bladder from said un-inflated configuration to said inflated configuration;

a tether extending between a first end coupled to said bladder and a second end engageable with a vehicle;

wherein said bladder in said inflated configuration defines a volume of less than one-tenth of a cubic meter; and at least one ice pick mounted on said bladder.

2. The recovery device of claim 1 wherein said tether is configured to support a weight of at least three hundred pounds.

3. The recovery device of claim 1 wherein said bladder envelops said canister when said bladder is in said un-inflated configuration.

4. The recovery device of claim 1 wherein said tether extends at least ten feet.

5. The recovery device of claim 4 wherein said tether extends between twenty and fifty feet.

6. The recovery device of claim 1 wherein said opening mechanism further comprises:

a valve adjustable between an open configuration and a closed configuration;

a sensor configured to detect moisture and emit a signal in response to detection of moisture; and an actuator operable to receive the signal from said sensor and adjust said valve to said open configuration.

7. The recovery device of claim 1 further comprising:

a pouch with an interior configured to contain said bladder when said bladder is in said un-inflated configuration and sized smaller than said bladder when said bladder is in said inflated configuration, wherein said second end of said tether is coupled to said pouch.

8. The recovery device of claim 7 wherein said bladder and said canister are disposed within said interior of said pouch when said bladder is in said un-inflated configuration.

9. The recovery device of claim 7 wherein said pouch defines a plurality of flaps that at least partially fold-over one another to enclose said interior.

10. The recovery device of claim 7 further comprising:

at least one strap coupled to said pouch and configured to couple said pouch to a vehicle.

11. The recovery device of claim 7 further comprising:

a carabiner interconnecting said second end of said tether and said pouch.

12. The recovery device of claim 7 wherein said pouch further comprises:

at least one flap enclosing said interior while in a closed position; and a magnetic clasp retaining said at least one flap in said closed position.

13. The recovery device of claim 12 wherein said at least one flap is further defined as:

four flaps that fold-over one another to enclose said interior, said magnetic clasp disposed on two of said four flaps.

* * * * *